United States Patent [19]

Hyca

[11] Patent Number: 4,777,891

[45] Date of Patent: Oct. 18, 1988

[54] CUTTING DEVICE FOR USE WITH A SEWING MACHINE

[75] Inventor: Bohumil Hyca, Korntal-Munchingen, Fed. Rep. of Germany

[73] Assignee: Union Special, G.m.b.H., Stuttgart, Fed. Rep. of Germany

[21] Appl. No.: 104,328

[22] Filed: Oct. 2, 1987

[30] Foreign Application Priority Data

Oct. 22, 1986 [DE] Fed. Rep. of Germany ..... 3635844
Mar. 5, 1987 [DE] Fed. Rep. of Germany ..... 3706996

[51] Int. Cl.[4] ..... D05B 37/04
[52] U.S. Cl. ..... 112/130; 112/136
[58] Field of Search ..... 112/121.26, 130, 122.3, 112/136, 121.27, 152, 122, 129

[56] References Cited

U.S. PATENT DOCUMENTS 3,818,851 6/1974 Marfoizio ..... 112/122.4 X
4,438,714 3/1984 Smith et al. ..... 112/130
4,635,575 1/1987 Sehips ..... 112/121.26
4,696,243 9/1987 Romano ..... 112/130 X

*Primary Examiner*—Andrew M. Falik
*Attorney, Agent, or Firm*—Powell L. Sprunger

[57] ABSTRACT

A cutting device on a sewing machine for cutting a tape or tape-like lace comprising, a first blade which is disposed on a swingable blade guide and which has a cutting edge which cooperates with the cutting edge of a further second blade secured to a holder. The cutting device has a feed device, provided with a shaft for feeding the tape or tape-like lace, the arrangement being such that the cutting edge of the blade on the swingable blade guide is movable in a substantially cylindrical path of swing about the center of swing of the blade guide, and such that the cutting edges of the blades are inclined towards one another when in a cutting position, the holder for the further blade being situated within the cylindrical path of swing of the cutting edge of the blade disposed on the swingable blade guide.

19 Claims, 6 Drawing Sheets

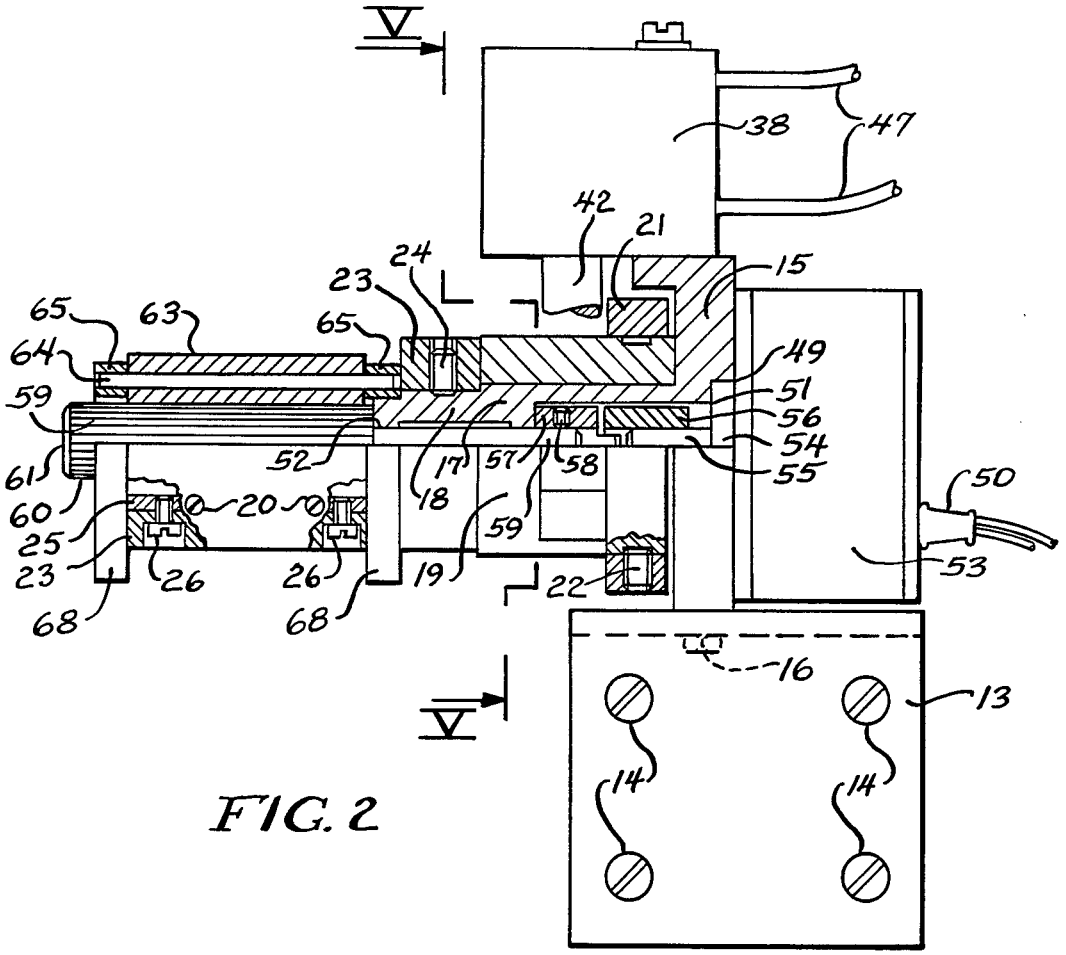
FIG. 2
FIG. 3
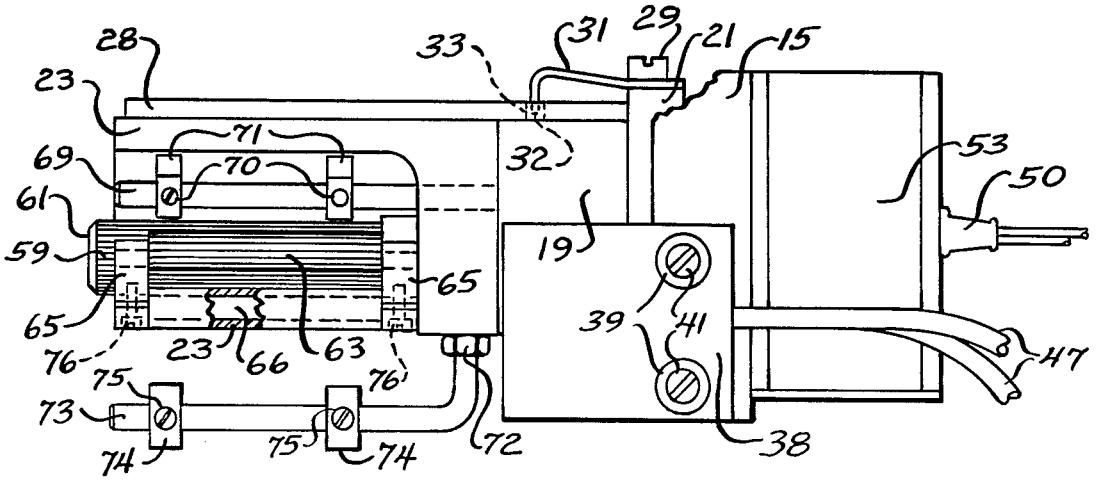

CUTTING DEVICE FOR USE WITH A SEWING MACHINE

BACKGROUND OF THE INVENTION

The invention relates to a cutting device for use with a sewing machine for cutting a tape or tape-like lace.

A cutting device for this purpose is known from U.S. Pat. No. 4,635,575. In the latter patent specification, shears are disposed between a feed device and the presser foot of the sewing machine. The open position of the blades of conventional shears, as well as the feed device, obstruct the operator's view of the point of stitch formation of the sewing machine. The accessibility of the sewing location during maintenance of the sewing machine is also obstructed by the arrangement and spatial requirement of the shears and by the feed device. The large number of parts required results in a complicated and hence expensive construction.

SUMMARY OF THE INVENTION

A principle feature of the present invention is the provision of an improved cutting device for use with a sewing machine.

The present invention resides in a cutting device for use with a sewing machine for cutting a tape or tape-like lace between the successive sewing of parts of work material, comprising a blade which is disposed on a swingable blade guide and which has a cutting edge which cooperates with the cutting edge of a further blade secured to a holder, and a feed device provided with a shaft for feeding the tape or tape-like lace, the arrangement being such that the cutting edge of the blade on the swingable blade guide is movable in a substantially cylindrical path of swing about the center of swing of the blade guide and the cutting edges of the blades are inclined towards one another when in the cutting position, the holder for the further blade being situated within the cylindrical path of swing of the cutting edge of the blade disposed on the swingable blade guide.

A feature of the invention is that the cutting device provides the machine operator with an unobstructed view of the point of stitch formation and such that maintenance can be carried out in s simplified manner.

Another feature of the invention is that a compact type of construction of the cutting device results from the use of a blade which is movable in a substantially cylindrical path of swing about the center of swing of its blade guide. The spatial requirement and the external shape of this cutting device remain approximately constant when the blades are in their open and closed positions.

Another feature of the invention is that the cylindrical construction of the cutting device enables simple adjustment of the feed device for the tape or tape-like lace with regard to the point of stitch formation of the sewing machine, since the blades can be turned concentrically and positioned in any desired direction. Hence, the cutting device can be aligned relative to the sewing location in conformity with the inherent stiffness of different tapes or tape-like lace, without impairing the operator's field of view of the point of stitch formation.

Still another feature of the invention is that preferably, the two blades are disposed along the shaft of the feed device. This dispenses with the additional spatial requirement of the feed device, the construction of the cutting device nevertheless remaining very simple.

Further features will become more fully apparent in the following description of the embodiments of this invention and from the appended claims.

DESCRIPTION OF THE DRAWINGS

In the drawings:

FIG. 2 is a partially sectioned front elevational view of the cutting device;

FIG. 3 is a plan view of the cutting device;

DESCRIPTION OF THE PREFERRED EMBODIMENTS

Figure 1:
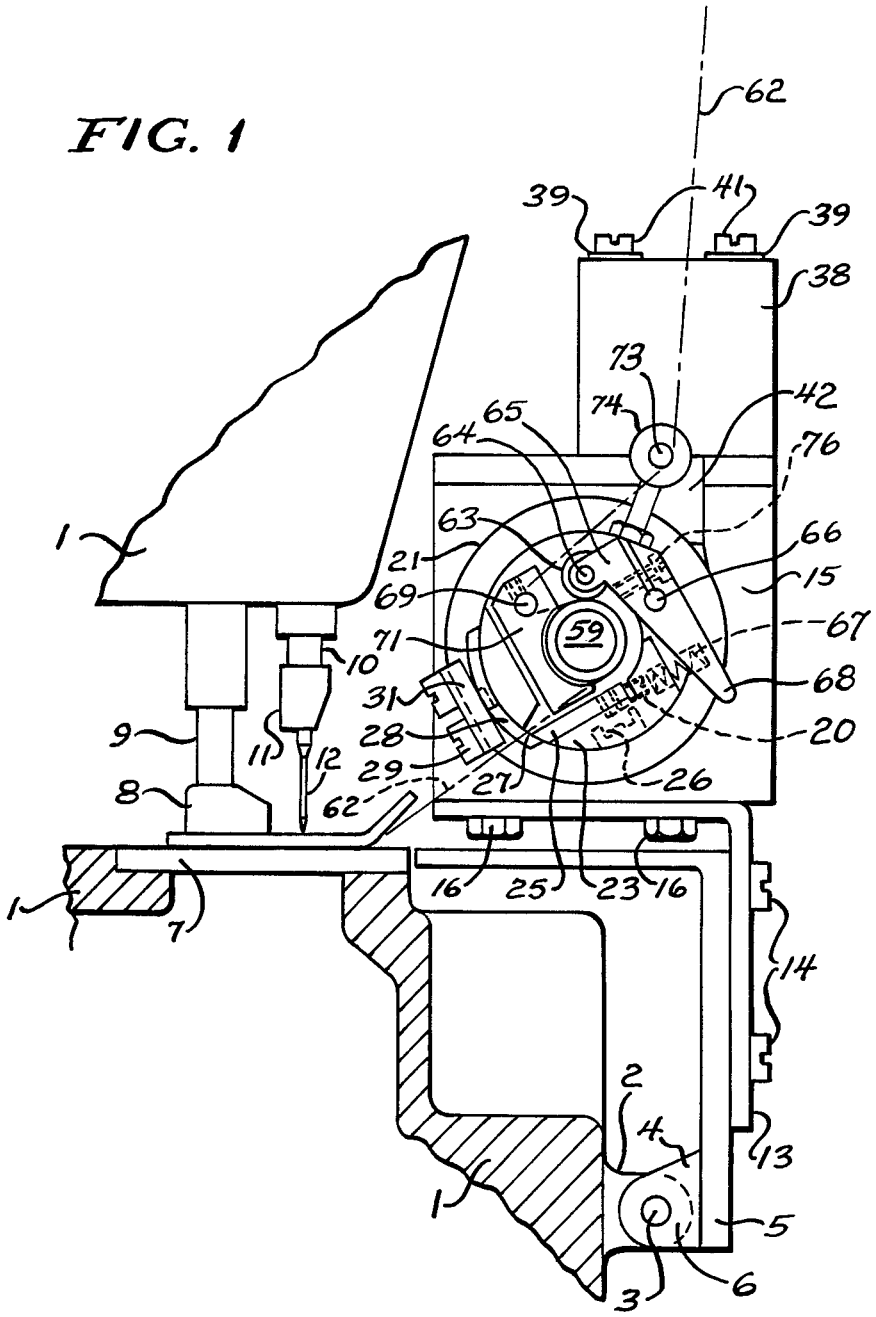
FIG. 1 is a fragmentary side elevational view of a cutting device on a sewing machine, taken partly in section, showing cutting blades being aligned relative to the sewing location.

Referring more particularly to FIG. 1, a sewing machine housing 1 has a lug 2 which, together with a pin 3 and a lug 4 on a plate 5, forms a hinge 6. The sewing machine housing 1 carries a needle plate 7 against the upper side of which rests a presser foot 8 which is resiliently mounted in the sewing machine housing 1 by way of a presser bar 9. A needle bar 10 is movable up and down in the sewing machine housing 1 and carries a needle head 11 in which a needle 12 is clamped.

An angled member 13 is secured to the hinged plate 5 by four screws 14. The angled member 13 carries a holder 15 which is screwed to the angled member 13 by the two screws 16.

The holder 15 has annular portions 17 and 18 (FIG. 2) which are disposed coaxially of one another. The annular portion 17 is surrounded by a swingable annular body 19 which carries a further annular body 21 (FIGS. 2 and 3). The annular portions 17 and 18 are integral with holder 15, which means that they do not rotate or swing. The annular body 19 is swingably mounted on portion 17. The further annular body 21 is adjustably mounted on annular body 19 and secured by screw 22. A screw 22 interconnects the two annular bodies 19 and 21 which are also referred to hereinafter as a blade guide. Only the two bodies 19 and 21 guide the blade 28. The position of blade 28 relative to blade 25 is adjustable by loosening screw 22 and by rotating body 21 relative to body 19.

The annular portion 18 carries a blade holder 23 which is secured thereto by a screw 24. A blade 25 is secured to the blade holder 23 by two screws 26, and a cutting edge 27 of the blade 25 can be aligned by means of two screws 20. The annular portion 18 is integral with holder 15. The blade holder 23 is clamped on the annular portion 18 by means of a screw 24 and block 25 is fixed on the knife holder 23 by two screws 26 which means all these parts do not move during cutting.

Figure 4:
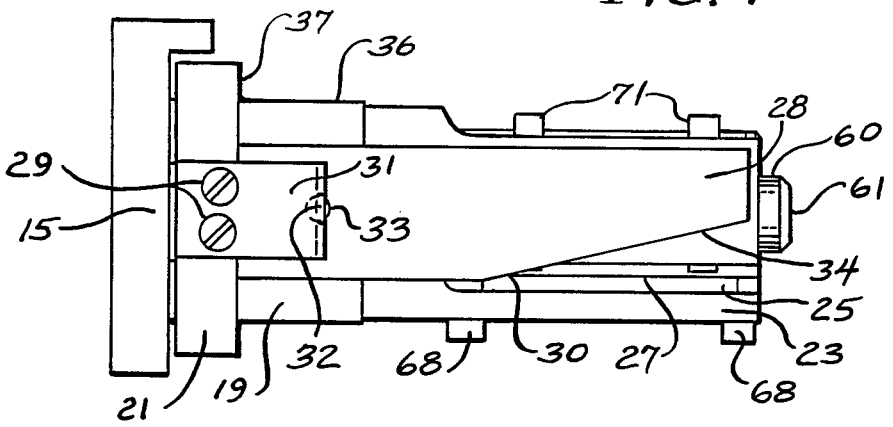
FIG. 4 is a rear elevational view of part of the cutting device.
Figure 5:
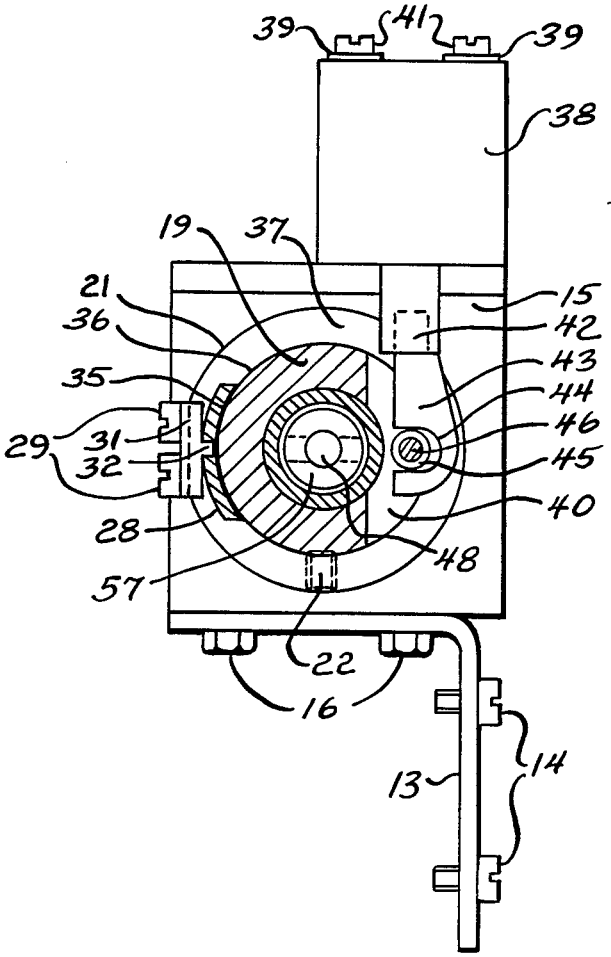
FIG. 5 is a sectional view taken substantially as indicated along the line V—V of FIG. 2.

FIG. 4 shows the mounting of a curved blade 28 to the blade guide 19, 21, the blade 28 having a cutting edge 34. An angled leaf spring 31 is secured to the annular body 21 by two screws 29 and has a lug 32 which engages a cut-away portion 33 in the blade 28. The inside 35 of the curved blade 28 abuts against the outer surface 36 of the annular body 19 (FIG. 5), the blade being positioned laterally by an end face 37 of the annular body 21.

The curved blade 28 is driven by a double-acting cylinder 38 to which pressure medium is admitted and which is secured to the holder 15 by two washers 39 and two screws 41. A push rod 42 extends out of the cylinder 38 and carries a bifurcated head 43 at its end. A bifurcation 44 embraces a roller 45 which is rotatably mounted on a spindle 46. The spindle 46 is pressed into the rotable annular body 19 which has a recessed portion 40 in the region of the roller 45.

The cylinder 38 is actuated by a pressure medium which flows through two flexible tubes 47 and which is changed over by a valve (not illustrated).

The push rod 42 moving up and down swings the annular body 19 about its center 48 of swing by way of the bifurcated head 43, the bifurcation 44, the roller 45 and the spindle 46, so that the cutting edge 34 of the blade 28 is moved in a substantially cylindrical path of swing about the center 48 of swing. The cutting edges 27 and 34 of the blades 25 and 28 are inclined towards one another in the cutting position 30 and are in punctiform contact with one another during the cutting operation. As the curved blade 28 is clamped on member 19 and member 19 is swingably mounted on annular portion 17 and driven by cylinder 28, also curved blade 28 swings around annular portion 17.

The holder 15 has three bores 49,51 and 52 which are reduced relative to one another in steps (FIG. 2). A boss or spigot 54 of a servo-motor 53 extends into the bore 49, the servo-motor 53 being flanged laterally to the holder 15. The servo-motor 53 is controlled by way of a cable 50 by means of a control device (not illustrated) which controls the motor in conformity with the speed at which the sewing machine feeds the material to be sewn.

A driver dog 56 is pressed onto a shaft 55 which extends out of the servo-motor 53. The dog 56 embraces a counter-member 57 which is secured to a stepped shaft 59 by a screw 58. The counter-member 57 also secures the shaft 59 against lateral displacement. The outer surface 60 of the thicker portion of the shaft 59 is knurled in order to facilitate the advance of a tape 62 or the tape-like lace around the shaft 59.

The free end 61 of the shaft 59 projects beyond the cutting edges of the blades 25 and 28 and permits manual actuation of the shaft 59. Hence, the tape 62 or the tape-like lace to be cut can be introduced into the cutting device manually.

A nip roller 63 secured to a spindle 64 is located opposite the shaft 59, and each end of the spindle 64 extends into a respective pivoted lever 65. Each of the two pivoted levers 65 is secured by a respective screw 76 to a spindle 66 which is rotatable mounted in the blade holder 23. A respective compression spring 67 is disposed between the blade holder 23 and an arm 68 of each pivoted lever 65. The nip roller 63 is thereby pressed resiliently against the shaft 59 or against the tape 62 or tape-like lace thereon. In order to facilitate the insertion of the tape 62 or tape-like lace into the cutting device, the roller 63 can be swung away from the shaft 59 by actuating the arm 68.

A bar 69 is pressed into the blade holder 23 parallel to the shaft 59, and carries two tape guide elements 71 which are clampable by means of screws 70. The tape guide elements 71 partially embrace shaft 59 in such a way that the tape 62 or tape-like lace is guided around the bar 69 and also in the region of the blade 25.

An angled bar 73 secured in the blade holder 23, and locked by means of a nut 72, serves as a pre-guide for the tape 62 or tape-like lace.

Two adjusting rings 74 are secured on the bar 73 by means of screws 75 and can be adjusted laterally in conformity with the width of the tape 62 or tape-like lace.

Figure 6:
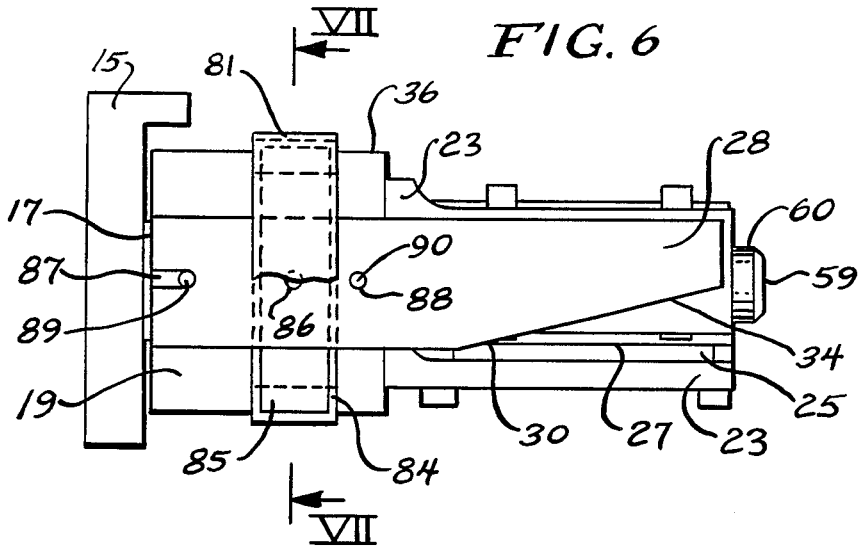
FIG. 6 is a rear elevational view of a part of another embodiment of the cutting device.
Figure 7:
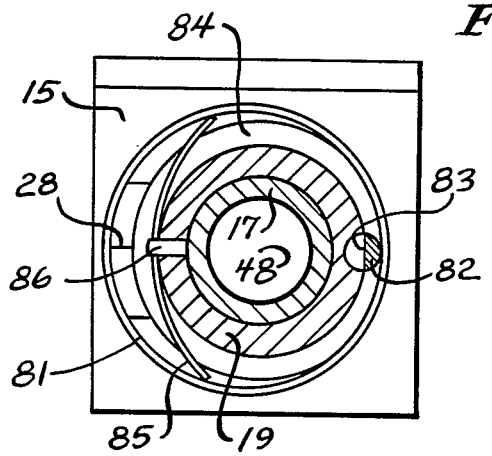
FIG. 7 is a sectional view taken substantially as indicated along the line VII—VII of FIG. 6, with the curved blade clamped not shown in section.
Figure 8:
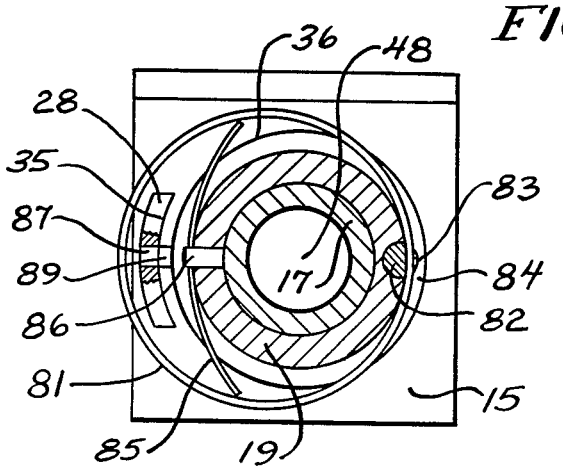
FIG. 8 is a sectional view taken substantially as indicated along the line VII—VII of FIG. 6, with the curved blade not clamped and not shown in section.
Figure 9:
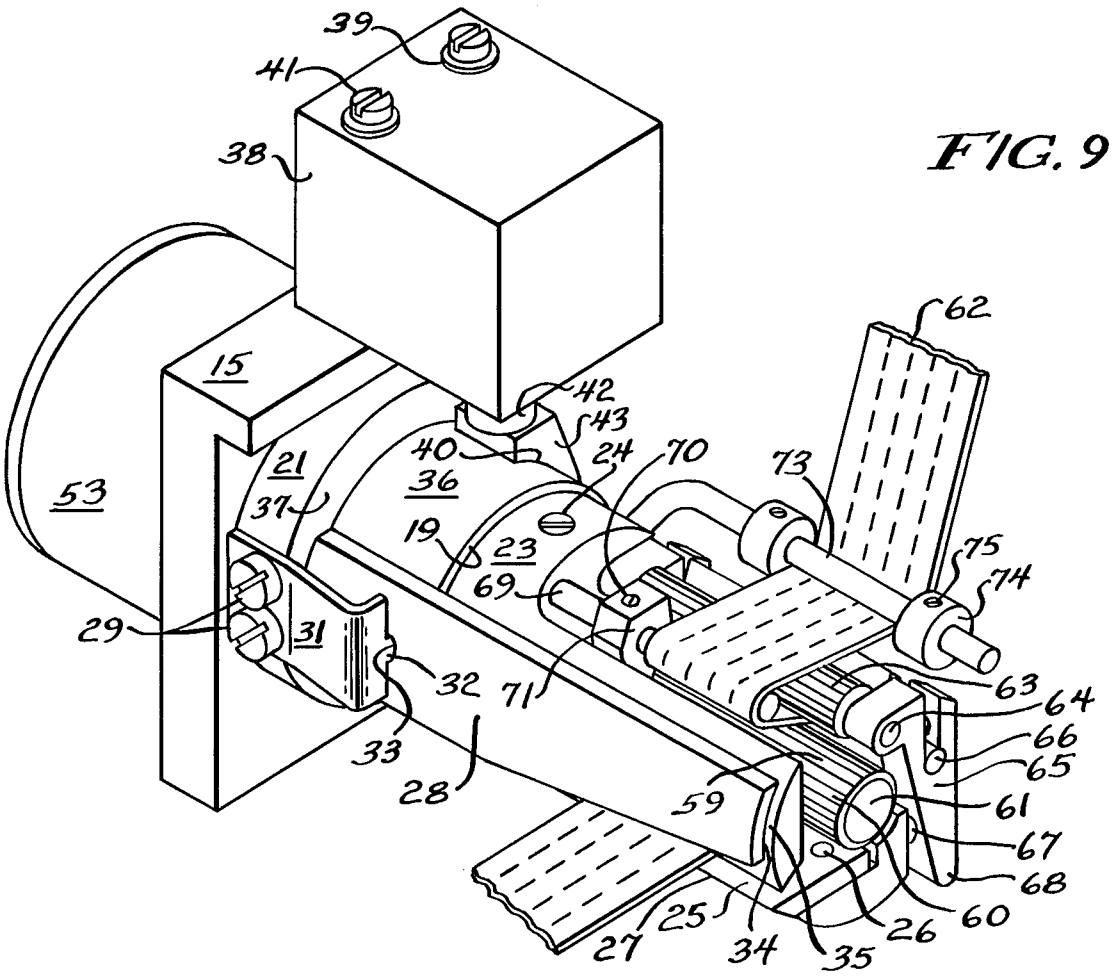
FIG. 9 is a perspective view of the cutting device.
Figure 10:
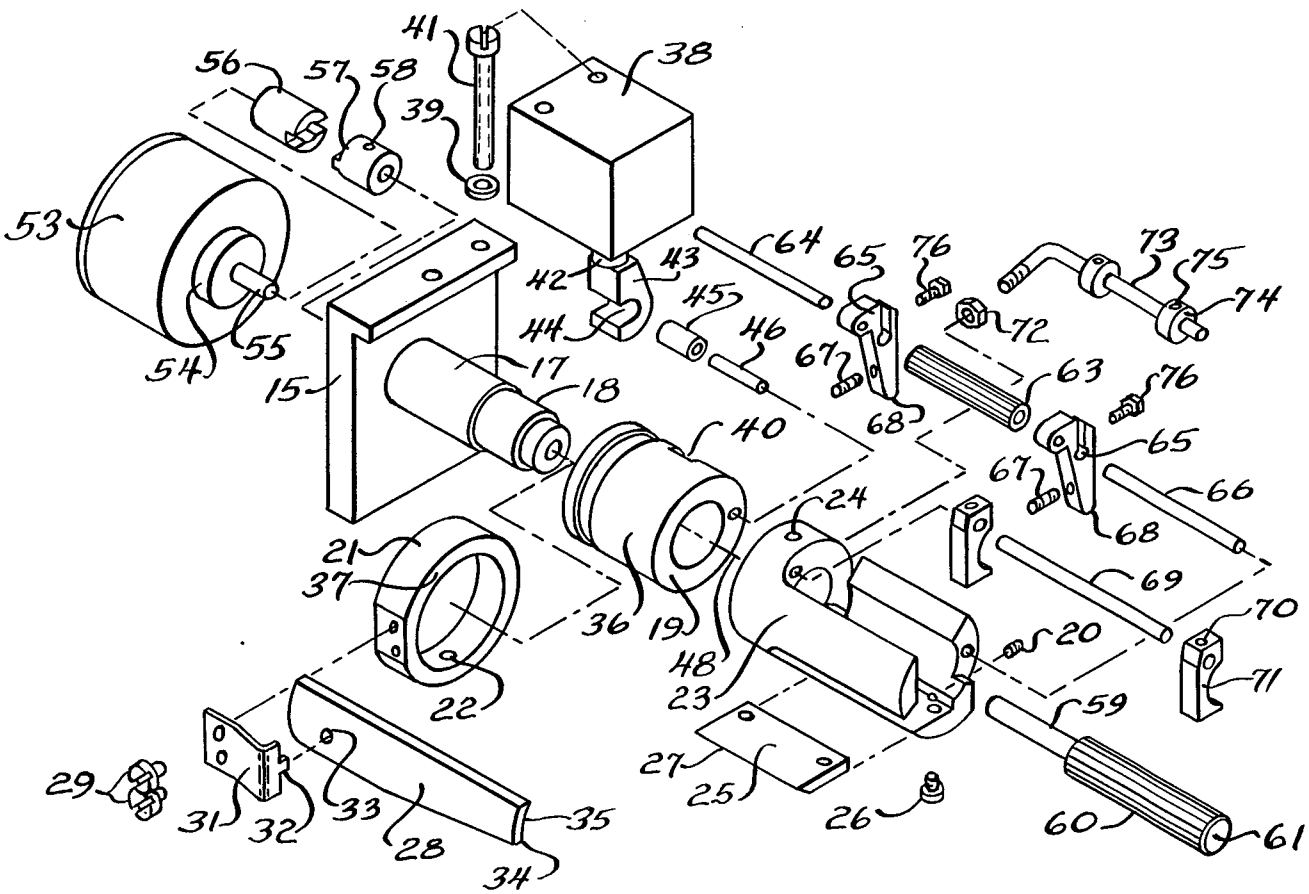
FIG. 10 is an exploded view of the cutting device.

In the embodiment of FIGS. 6, 7 and 8, in which parts like that of FIGS. 1 to 5 are denoted by like reference numerals, the annular body 19 is surrounded by an annular member 81 which clamps the blade 28 to the annular body 19 by means of a clamping element 82. The clamping element 82 has a step 83 and is rotatably mounted in the annular body 19. A spring element 85 is guided in an annular groove 84 in the annular body 19 and is held by a pin 86.

The curved blade 28 has a slot 87 and a hole 88 and is fixed in position on the rotatably mounted annular body 19 by holding pins 89 and 90.

FIG. 7 shows the curved blade 28 in its clamped state. The step 83 becomes effective to release the annular member 87 by turning the clamping element 82 (FIG. 8). Since the spring element 85 biasses the annular member 81 in the annular groove 84 laterally of the annular body 19, the curved blade 28 is freed and can be removed. A new or resharpened blade 28 can thereby be inserted into the cutting device in a very simple manner and can be reclamped by turning the clamping element 82. Alternatively, the clamping element 82 may be provided with an eccentric surface instead of the step 83 in order to pull the annular member 81 against the blade. A clamping force is exerted on the blade 28 by the resilient deformation of the annular member 81, thus ensuring that the blade 28 is reliably clamped during the cutting operation.

The foregoing detailed description is given for clearness of understanding only, and no unnecessary limitations should be understood therefrom, as modifications will be obvious to those skilled in the art.

What is claimed is:

1. A cutting device on a sewing machine for cutting tape or tape-like lace, comprising a first blade which is disposed on a swingable blade guide and which has a cutting edge which cooperates with the cutting edge of a further second blade secured to a holder, and a feed device, provided with a shaft for feeding the tape or tape-like lace to the cutting device, the arrangement being such that the cutting edge of the blade on the swingable blade guide is movable in a substantially cylindrical path of swing about the center of swing of the blade guide, and such that the cutting edges of the blades are inclined towards one another when in a cutting position, the holder for the further blade being situated within the cylindrical path of swing effected by the cutting edge of the blade disposed on the swingable blade guide in cutting the tape or tape-like lace.

2. A cutting device as claimed in claim 1, in which at least one blade is adjustable by means of said holder concentrically of a bearing of another holder.

3. A cutting device as claimed in claim 1, in which the blade on the swingable blade guide is curved in conformity with the path of swing of its cutting edge.

4. A cutting device as claimed in claim 1, in which the swingable blade guide comprises two releasably interconnected annular bodies.

5. A cutting device as claimed in claim 4, in which the first blade is curved and abuts against an outer surface of one annular body and against an end face of the second annular body and is fixed in position by means of a retaining member.

6. A cutting device as claimed in claim 1, in which an annular member surrounds the swingable blade guide and the blade therein.

7. A cutting device as claimed in claim 6, in which the annular member is displaceable radially of the blade guide by means of a clamping element.

8. A cutting device as claimed in claim 6, in which the annular member is resiliently deformable.

9. A cutting device as claimed in claim 8, in which a spring element urges the annular member eccentrically with respect to the blade guide.

10. A cutting device as claimed in claim 1, in which the movable blade on the swingable blade guide is drivably connected to an adjusting means.

11. A cutting device as claimed in claim 1, in which the cutting edge of the further second blade is alignable with respect to the first blade by means of screws.

12. A cutting device as claimed in claim 1, in which the two blades are disposed along the shaft of the feed device.

13. A cutting device as claimed in claim 1, in which the shaft of the feed device is driven by means of a servo-motor.

14. A cutting device as claimed in claim 1, in which a free end of the shaft of the feed device projects axially beyond the cutting edges of the blades.

15. A cutting device as claimed in claim 1, in which a resiliently mounted nip roller is located opposite the shaft of the feed device.

16. A cutting device as claimed in claim 1, in which the cutting device is secured to a plate which is adapted to be hinged to the sewing machine by means of a hinge.

17. A cutting device as claimed in claim 1, in which at least one tape guide element is secured to a bar and is adjustably secured by screws and at least partially surrounds the shaft of the feed device.

18. A cutting device on a sewing machine for cutting tape or tape-like lace comprising, a first blade supported on a swingable blade guide and having a cutting edge, with the cutting edge of the first blade being movable in a substantially cylindrical path of swing about the center of swing of the blade guide;

a second blade secured to a holder and having a cutting edge, with the cutting edge of the first blade cooperating with the cutting edge of the second blade, with the cutting edges of the first and second blades being inclined towards one another when in a cutting position, and with the holder for the second blade being situated within the cylindrical path of swing effected by the cutting edge of the first blade in cutting the tape or tape-like lace; and a feed device having a shaft for feeding the tape or tape-like lace to the cutting device, wherein the cutting edges of the first and second blades are aligned with the longitudinal axis of the shaft of the feed device.

19. The cutting device of claim 1 in which at least one blade is adjustable by means of a second holder relative to said holder.

* * * * *